US009855565B2

(12) United States Patent
Knospe et al.

(10) Patent No.: US 9,855,565 B2
(45) Date of Patent: Jan. 2, 2018

(54) CENTRIFUGE AND METHOD FOR MONITORING A TORQUE

(75) Inventors: Volker Knospe, Muenster (DE); Richard Korzinetzki, Beckum (DE)

(73) Assignee: GEA Mechanical Equipment GmbH, Oelde (DE)

( * ) Notice: Subject to any disclaimer, the term of this patent is extended or adjusted under 35 U.S.C. 154(b) by 1038 days.

(21) Appl. No.: 14/112,286

(22) PCT Filed: Apr. 17, 2012

(86) PCT No.: PCT/EP2012/056976

§ 371 (c)(1),
(2), (4) Date: Jul. 7, 2014

(87) PCT Pub. No.: WO2012/143342

PCT Pub. Date: Oct. 26, 2012

(65) Prior Publication Data

US 2014/0315706 A1 Oct. 23, 2014

(30) Foreign Application Priority Data

Apr. 18, 2011 (DE) ..... 10 2011 002 126

(51) Int. Cl.
*B04B 1/20* (2006.01)
*B04B 9/08* (2006.01)
*B04B 3/04* (2006.01)

(52) U.S. Cl.
CPC ..... *B04B 3/04* (2013.01); *B04B 1/2016* (2013.01); *B04B 9/08* (2013.01); *B04B 2001/2025* (2013.01)

(58) Field of Classification Search
CPC B04B 3/04; B04B 9/08; B04B 1/2016; B04B 2001/2025

(Continued)

(56) References Cited

U.S. PATENT DOCUMENTS 5,120,298 A * 6/1992 Jager ..... B04B 9/12 494/53
5,948,271 A * 9/1999 Wardwell ..... B04B 1/20 210/143

(Continued)

FOREIGN PATENT DOCUMENTS

DE 94 09 109 U1 11/1995
DE 10 2006 028 804 A1 12/2007

(Continued)

OTHER PUBLICATIONS

International Preliminary Report on Patentability including a Written Opinion (PCT/ISA/237) dated Oct. 22, 2013 (Six (6) pages).

(Continued)

*Primary Examiner* — Charles Cooley
(74) *Attorney, Agent, or Firm* — Crowell & Moring LLP

(57) ABSTRACT

A solid bowl screw centrifuge for processing drilling muds includes a rotatable drum and a rotatable screw. The centrifuge has a drive device for driving the drum and the screw with a drive motor as well as a gear assembly for producing a differential rotational speed between the drum and the screw when the centrifuge is in operation. A gear input shaft of the gear assembly is rotationally fixed by an overload lever arm that can be triggered in the event of a torque overload. The overload lever arm is directly and detachably connected with one end thereof and at a radial distance from the rotation axis of the gear input shaft to the gear input shaft or to a part that is connected thereto in a rotationally fixed manner. A method is provided for monitoring the torque on the gear input shaft.

16 Claims, 4 Drawing Sheets

(58) Field of Classification Search
USPC ..... 494/53, 84
See application file for complete search history.

(56) References Cited

U.S. PATENT DOCUMENTS

| | | | | |
|---|---|---|---|---|
| 6,143,183 | A * | 11/2000 | Wardwell | B04B 1/20 210/143 |
| 7,883,457 | B2 * | 2/2011 | Overberg | B04B 1/2016 475/5 |
| 9,457,358 | B2 * | 10/2016 | Overberg | B04B 1/2016 |
| 2009/0105059 | A1 * | 4/2009 | Dorry | B04B 1/2016 494/37 |
| 2009/0247384 | A1 * | 10/2009 | Overberg | B04B 1/2016 494/51 |
| 2012/0065903 | A1 * | 3/2012 | Overberg | B04B 1/2016 702/41 |
| 2014/0235420 | A1 * | 8/2014 | Hilpert | B04B 11/04 494/10 |
| 2014/0315706 | A1 * | 10/2014 | Knospe | B04B 1/2016 494/37 |
| 2016/0318042 | A1 * | 11/2016 | Hilpert | B04B 11/04 |

FOREIGN PATENT DOCUMENTS

| | | | | |
|---|---|---|---|---|
| FR | 2 507 798 | A1 | 12/1982 | |
| FR | 2507798 | A1 * | 12/1982 | B04B 1/2016 |

OTHER PUBLICATIONS

International Search Report dated Oct. 15, 2012 with English translation (five (5) pages).

* cited by examiner

CENTRIFUGE AND METHOD FOR MONITORING A TORQUE

BACKGROUND AND SUMMARY OF THE INVENTION

The invention relates to a centrifuge and to a method for monitoring a torque.

Centrifuges which are used for the processing of drill sludge are known. In the processing of such sludge, also called drilling mud, a centrifuge is usually operated at a lower load than in the processing of other products. One reason for this is that, in the event of failure because of overloading, complicated demounting and cleaning of the centrifuge have to be carried out.

DE 10 2006 028 804 A1 discloses a generic centrifuge with a drum and with a screw which are driven by a first motor and preferably a second motor. A gear arrangement which has a plurality of gear stages is arranged between the motors and the drum and screw. Torques are introduced into the first and the second gear stage on four shafts, and a first and a second gear stage is driven on at least three shafts. The arrangement serves, inter alia, for generating a differential rotational speed between the drum and screw.

In a design variant, in DE 10 2006 028 804 A1, an unregulated drive is implemented in which a gear input shaft is detained. In this context, the possibility of implementing torque overload protection on the stationary shaft is described.

DE 94 09 109 U1 discloses a centrifuge with two epicyclic gear stages, combined into a synchronized gear. In one of the design variants explained, an input of the epicyclic gear stages is detained and a signal is determined at this input as a function of the torque at the screw. This signal can be used for monitoring, overload indication and/or damping measures.

FR 81 11 786 discloses a solid bowl screw centrifuge with a torque overload protection device having a lever which is held on a jib of a gear input shaft via intermediate elements. A lever end is held between two running rollers which are connected to a spring support via a double-jointed arm. In this case, when the centrifuge is in operation, the lever presses against one of the two running rollers which is connected to a measuring instrument. This measuring instrument determines the force exerted by the lever and, when a predetermined limit value is overshot, outputs a control command to a centrifuge control device which stops the inflow of product into the centrifuge. In the event of too high an overload, the double-jointed arm can collapse, the fixing of the lever being released by the running rollers. The gear input shaft of the centrifuge is thus no longer fixed or is released.

The object of the invention is to provide a centrifuge which makes it possible to process drill sludge, as product, in an especially suitable way.

The invention achieves this and other objects by providing a solid bowl screw centrifuge with a rotatable drum and with a rotatable screw for the processing of drill sludges. The centrifuge has a drive device for driving the drum and the screw, with a drive motor and with a gear arrangement for generating a differential rotational speed between the drum and the screw during the operation of the centrifuge. A gear input shaft of the gear arrangement is rotationally fixed by an overload lever arm that is triggerable in a torque overload event. The overload lever arm, spaced apart at one end radially with respect to the axis of rotation of the gear input shaft, is releasably connected directly to the gear input shaft or to a part connected thereto in a rotationally fixed manner.

The invention further achieves this and other objects by providing a method for monitoring the torque on a gear input shaft of a solid bowl screw centrifuge in the clarification of drill sludge. The method includes the following steps: (a) clarification of drill sludge if the torque or the solid bowl screw centrifuge is below a first limit value; (b) changing of at least one operating parameter of the solid bowl screw centrifuge if the torque reaches or overshoots the first limit value; (c) shutdown of the solid bowl screw centrifuge if the torque reaches or overshoots a second limit value; and (d) automatic or controlled triggering of torque overload protection if the derivation of the torque according to time overshoots a limit value dM/dt.

As a result of the special configuration of the overload lever arm and its connection to the gear input shaft, structural simplification, as compared with the prior art, is achieved.

The overload lever arm in this case serves advantageously as a torque support which, in the event of overload, comes loose from the gear input shaft or from the part, such as an arm or pulley, connected fixedly in terms of rotation to it.

In this context, "a normal operation" means that the torque acting upon the overload lever arm is lower than a stipulated first limit value. When this first limit value is overshot, operating parameters are first modified in a suitable way. Thus, for example, the product inflow can be throttled.

If a second, higher limit value for the torque is overshot, the solid bowl screw centrifuge is shut down and assumes a safe state.

The term "overload event" means that the torque rises to an extent such that compensation by the influencing of process parameters and even a shutdown can no longer take place in due time. In this case, the overload lever arm is compressed. As a result, the gear input shaft is released and the belt drive of the motor can no longer transmit torque via the gear to the screw or the drum.

The overload lever arm is preferably designed as a cylinder/piston arrangement which, in particular, is designed to be telescopically resilient in a fluidic, that is to say pneumatic or hydraulic way, or which has a mechanical spring element such as a helical spring.

In order to prevent an overload event in due time even before this state is reached, the centrifuge has a torque determiner for determining the instantaneous torque load upon the cylinder/piston unit. These devices can, for example, determine the length variation of the overload lever arm and/or determine the relative or absolute variation in the tilt angle of the piston rod with respect to an initial position. This information can be used to judge what precisely is the prevailing operating state.

Methods which operate by torque overload protection and which shut down the inflow at a first limit value already are known in the prior art. However, by means of the method according to the invention, by overall two limit values being stipulated with a change in the operating parameters taking place when a first limit value is reached or overshot and with a shutdown occurring when a second limit value is reached or overshot, an overload event can be prevented even more reliably. Only when the overload protection is triggered does complicated cleaning of the centrifuge, in particular of the screw, become necessary. This can be prevented, inter alia, by the novel step of timely shutdown.

The use of the method in the processing of drill sludge has proved to be especially expedient since the processing of drill sludge entails the occurrence of unforeseen states which lie outside the normal operation of the centrifuge. Via more differentiated monitoring of the torque with the aid of the stipulation of a first and of a second limit value, the percentage of overload events occurring can be surprisingly reduced.

The invention is explained in more detail below by means of an exemplary embodiment, with reference to the accompanying drawings.

DETAILED DESCRIPTION OF THE DRAWINGS

Figure 1:
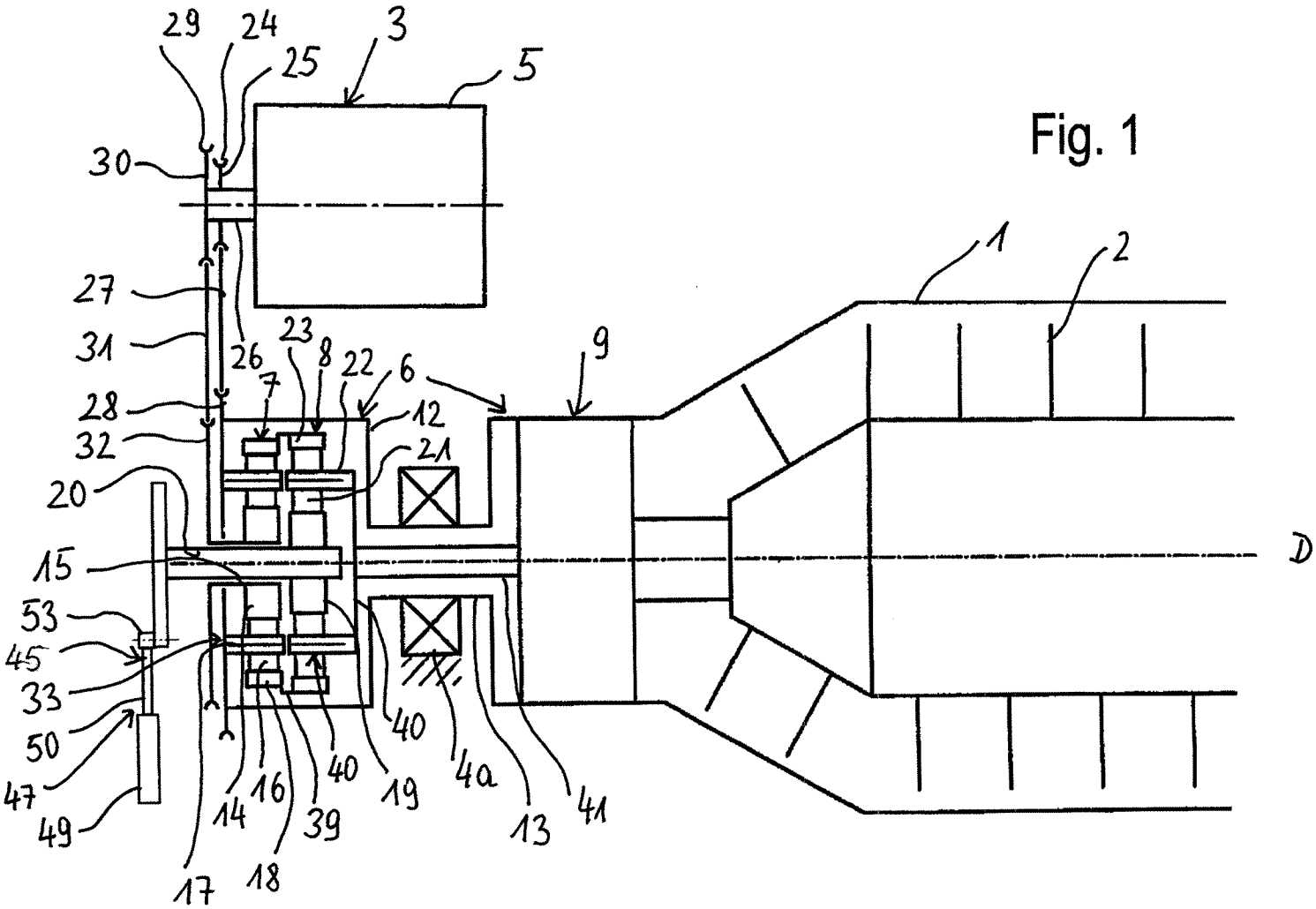
FIG. 1 shows a diagrammatic sectional illustration of a solid bowl screw centrifuge.

FIGS. 1 to 3*a* and 3*b* show a solid bowl screw centrifuge with a rotatable drum 1 having a preferably horizontal axis of rotation D and with a likewise rotatable screw 2 which is arranged inside the drum 1 and has a centrifuge drive 3 for rotating the drum 1 and screw 2. The drum is arranged between a drive-side and a drive-remote drum bearing 4*a*, 4*b*.

The centrifuge drive 3 has a motor 5 and a gear arrangement arranged between the motor 5 and the drum 1 and screw 2.

The gear arrangement comprises, for example, a single gear, what is known as a planetary gear 6, with three or more gear stages 7, 8, 9 which follow the motor 5. In a configuration selected here, the first two gear stages 7, 8 and the third gear stage 9 are arranged, respectively, on the two axial sides of the drive-side drum bearing 4*a*. Alternative configurations, for example with all the gear stages 7, 8, 9 inside or outside the drum bearing 4*a* (in relation to the drum 1), can likewise be implemented.

The design of the gear 6 is in this case such that, during operation, a differential rotational speed can be set between the rotational speed of the drum 1 and the rotational speed of the screw 2.

The first gear stage 7 and the second gear stage 8 of the gear 6 are in this case designed in the manner of a planetary gear. The first gear stage 7 forms a kind of prestage and the second gear stage 8 forms a kind of main stage, which are both arranged in a common housing 12. The first and second gear stage 7, 8 are designed in the manner of an epicyclic gear, the housing 12 being co-driven and in turn driving the drum 1 which is rotationally fixed to the housing 12 preferably via a hollow shaft 13.

The first gear stage 7 has in the housing 12 a sun wheel 14 on a sun wheel shaft 15, planet wheels 16 on planet wheel axles 17, which are combined into a planet wheel carrier 33, and an outer ring wheel 18.

Furthermore, the second gear stage 8 has, likewise inside the housing 12, a sun wheel 19 on a gear input shaft 20, also known as a sun wheel shaft, planet wheels 21 on planet wheel axles 22, which are combined into a planet wheel carrier 40, and an outer ring wheel 23.

The motor 5 drives the housing 12 and the planet wheels 16 directly (not illustrated) or indirectly (via a first wrap-around gear 24 with a belt pulley 25 on its motor shaft 26, with a belt 27 and with a belt pulley 28 which is coupled fixedly in terms of rotation to the housing 12 and to the planet wheel axles 17 of the planet wheels 16 of the first gear stage 7, so that it also forms the planet carrier 33 here). The belt pulley 28 may also be formed in one piece with the housing 12 or be formed on the outer circumference of the latter.

Furthermore, the first motor 5 drives the (hollow) shaft 15 for the sun wheel 14 of the first gear stage 7 directly or indirectly (for example, via a second belt drive 29 with a belt pulley 30 on its motor shaft 26, with a belt 31 and with a belt pulley 32).

Moreover, the ring wheel 18 is coupled fixedly into rotation via an intermediate piece to a ring wheel 23 of the second gear stage 8 to form an intermediate shaft 39 or is formed in one piece with said ring wheel.

The planet wheel axles 22 of the planet wheels 21 of the second gear stage 8 drive via the planet wheel carrier 40 an intermediate shaft 41 to the third gear stage 9 which (as a simple or again multiple output gear stage) drives (merely indicated diagrammatically here) the screw 2.

Between the housing 12 and the intermediate shaft 41, a differential rotational speed can be implemented, which can be set by means of the first and the second gear stage 7, 8 and which is determined, on the one hand, by the rotational speed of the gear input shaft 20 of the second gear stage 8 and, on the other hand, on the rotational speed of the intermediate shaft 39.

To set the differential rotational speed, in the present exemplary embodiment the gear input shaft 20 is fixed at zero. This arrangement may also be designated as a zero point drive.

The rotational speed of the intermediate shaft 39 is in this case determined by the rotational speed of the sun wheel shaft 15 of the sun wheel 14 of the first gear stage 7 and is therefore also dependent on the initial rotational speed of the (drum) motor 5.

Both the sun wheel shaft 15 and the housing 12 have a rotational speed different from zero, the rotational speed of the housing 12 being coupled fixedly to the rotational speed of the sun wheel shaft 15.

It is also advantageous that the first two gear stages 7, 8 are arranged inside the common (rotatable) housing 12 since this can be implemented cost-effectively and affords a compact build.

In this case, the first gear stage 7 forms a kind of prestage which acts together with the second gear stage 8 as a kind of overriding primary gear stage.

Figure 2:
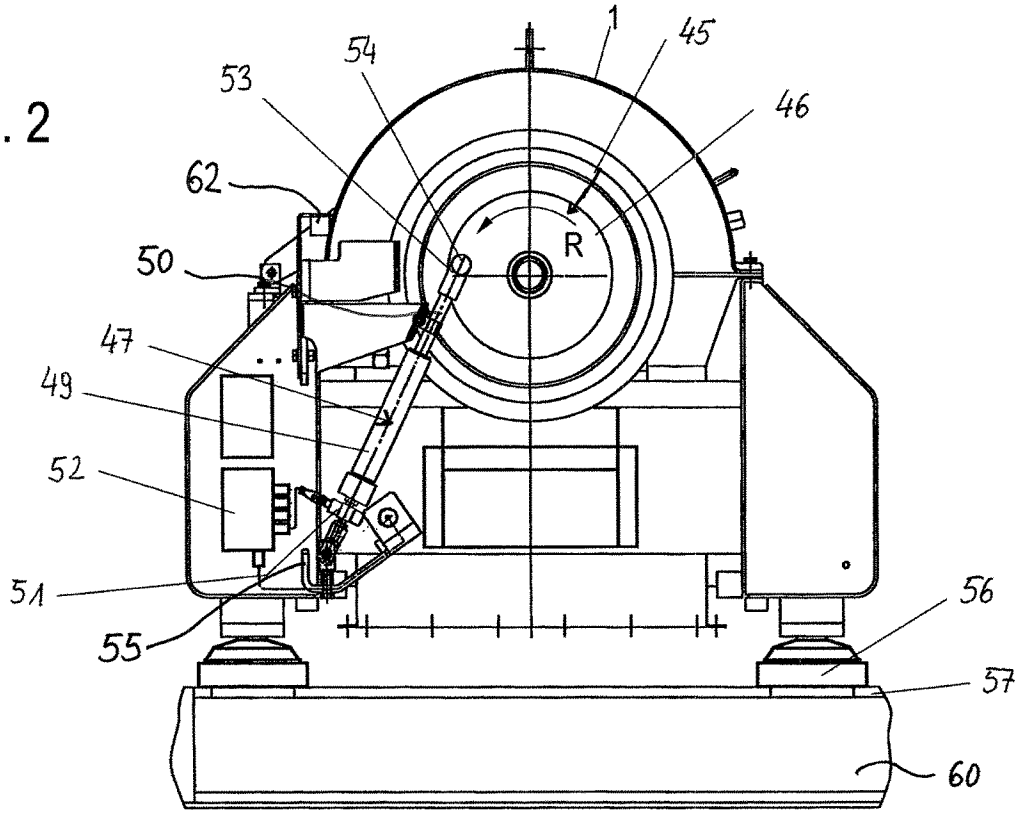
FIG. 2 shows a shows a front view of a solid bowl screw centrifuge.

According to the arrangement of FIGS. 1 and 2, the prestage lying outside the drive-side drum bearing 4*a* makes it possible to have a dynamically rigid tie-up to the rotating system.

However, the first two gear stages 7, 8 may also be arranged completely together (if appropriate, with further stages) between the drive-side drum bearing 4*a* and the drum 1 or be arranged outside the drive-side drum bearing 4*a* in relation to the drum 1.

It should also be mentioned, as an advantage of the designs, that the dependence of the differential rotational speed upon the slip and upon the load state of the centrifuge is insignificant. The stipulated differential rotational speed range can be set in a simple way by changing the belt or belt pulleys.

It must be recognized here that the differential rotational speed can be preset by exchanging the belt pulley of the wrap-around gear, the differential rotational speed being variable, during operation, within the given bandwidth ranges by regulating or controlling the motor 5.

In this design, there is no reversal of rotational speed, which, in combination with a planetary gear of conventional type of construction results in a leading screw.

Owing to the now free gear input shaft 20 of the second gear stage 8 being detained, it is possible to implement a drive which, although being preset, is unregulated during operation. Here, in each case, the torque is measured and overload protection 45 implemented on the stationary shaft.

The structural set-up and the functioning of the overload protection 45 are described in more detail below.

In FIGS. 1 and 2, the gear input shaft 20 has a pulley 46 at its free end. An overload lever arm 47 is supported outside the axis of rotation D on this pulley 46. This overload lever arm 47 may be designed in various ways and, in its function as a torque support, prevents a rotational movement of the gear input shaft 20.

In this case, in the preferred design variant, the overload lever arm 47 is designed as a cylinder/piston unit or as a compression spring with a cylinder housing 49 and with a piston rod 50 moveable linearly thereto. In this case, force is exerted in the manner of a restoring force upon the piston rod 50, in particular a spring force or pressure by a fluid, such as, for example, a gas or liquid. When force acts upon the piston rod 50, the latter moves in relation to the cylinder housing 49.

In the exemplary embodiment of FIG. 2, the overload lever arm is, for example, a pneumatic cylinder which opposes a restoring force by gas pressure to the force which the screw transmits to the pneumatic lever via the pulley.

When the centrifuge is in operation, the overload lever arm exerts a restoring force counter to the direction of rotation R of the drum 1 and of the screw 2, and by use of this force keeps the gear input shaft 20 at rest.

In this case, the force which acts upon the overload lever arm via the gear input shaft is measured by a load cell 51 which is secured to the overload lever arm 47. Measurement may take place in various ways, such as, for example, by measuring the length variation of the elements of the overload lever arm which are moveable with respect to one another or by measuring the angle of the lever arm to the base or stand to which it is secured. In the case of a pneumatic cylinder (gas compression spring), it is also possible to measure the gas pressure.

Various control commands can be output as a function of the force determined. Thus, if a stipulated limit value is overshot only slightly, the inflow of product into the centrifuge can be throttled or completely stopped. Thus, by the torque being determined during the operation of the centrifuge, for example, the drive power of the motor 5 or the inflow capacity of the product can be regulated, so that the centrifuge can be operated up to its performance limit.

For this purpose, the load cell 51 outputs a signal which is transferred to a computing unit 52 and is balanced with a limit value. In the present example, the load cell 51 is in a compact way arranged directly on the overload lever arm 47 or integrated into this.

At its free end facing the pulley, the overload lever arm 47 has a receptacle 53, here, for example, a metal clip, which presses against a coupling means 54, preferably a bolt of the pulley 46, and thus keeps the gear input shaft 20 at a standstill.

When the centrifuge is in operation, the force which acts upon the overload lever arm is measured and the torque is determined from this. When the solid bowl screw centrifuge is in normal operation, clarification of the drill sludge is carried out. This clarification takes place by the introduction of drill sludge into the centrifuge. In the centrifugal field of the centrifuge, the drill sludge is converted into a liquid phase and a solid phase which are discharged from the centrifuge through different outflows.

As soon as a first limit value is reached or overshot, the overload lever arm remains in its original position, but operating parameters are modified. The inflow is preferably shut down and a safe state thus generated.

Insofar as a second limit value of the torque M is reached or overshot, the centrifuge will be shut down and assumes a safe state. Even when the second limit value is reached or overshot, the overload lever arm remains in its original position.

Only in a serious case or overload event, in which the torque in the gear and consequently the force on the overload lever arm rise so quickly that a shutdown would not be possible quickly enough, does the piston rod 50 of the overload lever arm 47 collapse in a linear movement A and comes loose from the gear input in a concerted tilting movement B during the rotation of the gear 6. The rise of the torque is dM/dt.

Figure 4A:
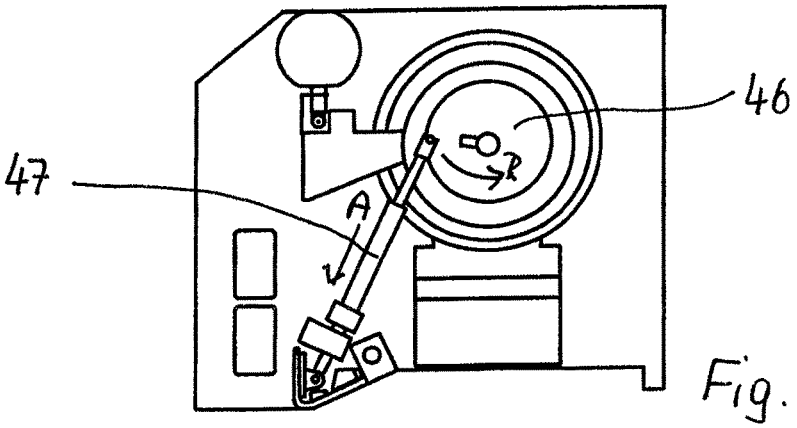
FIGS. 4*a*)-4*c*) show part views of a solid bowl screw centrifuge from FIGS. 2 and 3 in various operating states.
Figure 4B:
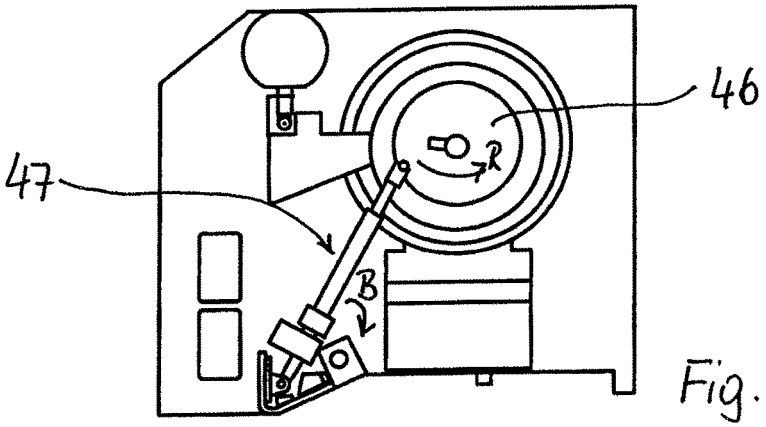
Figure 4C:
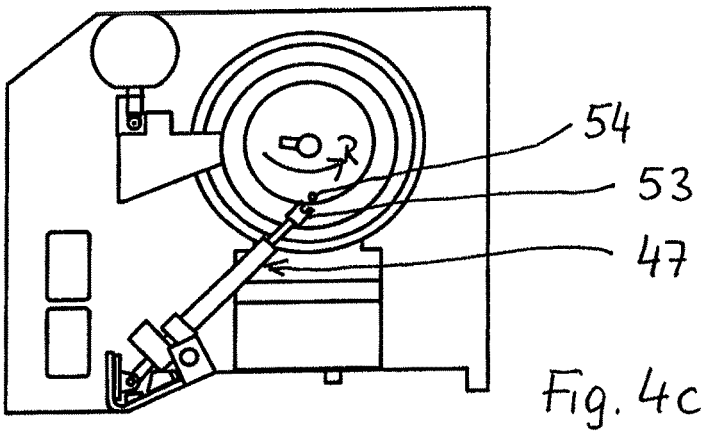

If a stipulated limit value for the rise of the torque dM/dt is overshot and the force on the overload lever arm rises too quickly, the latter comes loose from the gear input. This is illustrated diagrammatically in FIGS. 4*a*-4*c*. The release of the overload lever arm from the gear input corresponds in this case to the triggering of torque overload protection.

The piston rod 50 in this case has at its end a receptacle 53 which is connected rigidly to the piston rod 50 or is formed at the end on the piston rod 50.

Figure 3B:
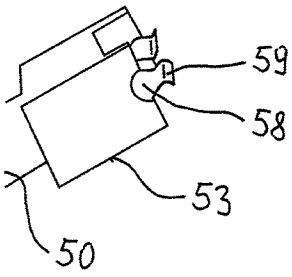
FIG. 3*b* shows a detail view of the circled area of FIG. 3*a*.
Figure 3A:
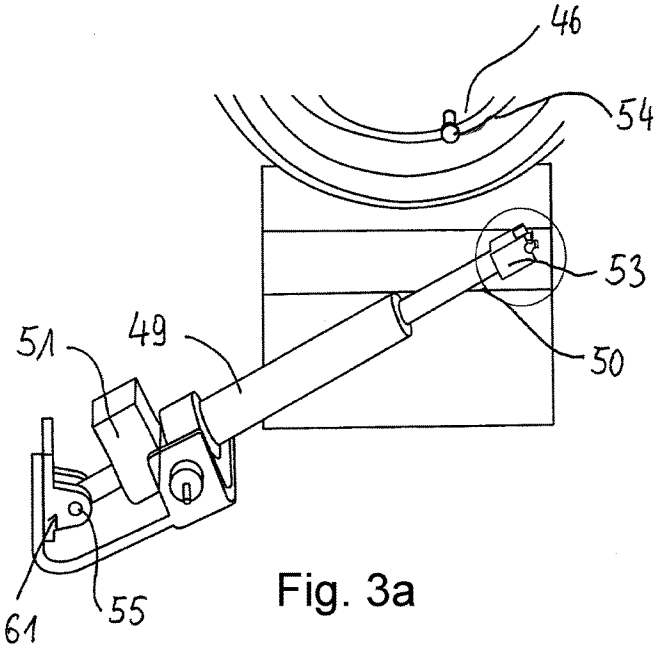
FIG. 3*a* shows a detail view of an overload lever from FIG. 2

The receptacle may preferably be shaped in the form of a channel 58 with a shoulder 59 for guiding the bolt 54. As shown in FIGS. 3*a* and 3*b*, the bolt 54 of the pulley 46 lies in the channel 58 of the receptacle 53.

When the centrifuge is in operation, the pulley 46 exerts a force upon the bolt 54 in the direction of rotation R of the drum 1.

If the piston rod 50 penetrates into the cylinder housing 49 of the overload lever 47, the pulley 46 is decoupled from the overload lever arm 47 and moves in the direction of rotation R. In decoupling, the bolt 54 comes loose from the channel 58 of the receptacle 53 during the rotational movement, leading to the decoupling of the pulley 46 and of the screw 2 connected thereto. In this case, the overload lever arm is arranged pivotably about the pivot pin 55 of a rocking joint 61. As a result of decoupling, the gear input shaft 20 is freed and co-rotates.

The present invention has in this case the advantage that an emergency stop and therefore cleaning of the screw and renewing of the decoupled overload lever arm are necessary only when the third limit value is reached, that is to say in the event of a fault. Moreover, optimal utilization of the centrifuge is achieved by force measurement or the determination of the torque and by the operating parameters, such as, for example, the drive power of the motor 5, which are coordinated with these.

During the operation of the centrifuge or while it is being stopped, vibrations or resonant oscillations may occur. These can be damped by damping feet 56 and damping plates 57, so that the centrifuge does not transmit any oscillations to a machine stand 60 or to the base. The operation of the centrifuge can additionally be set and monitored by devices for the determination of oscillations 62, for example a vibration sensor.

LIST OF REFERENCE SYMBOLS

1 Drum
2 Screw

3 Centrifuge drive
4 Drum bearing
5 Motor
6 Planetary gear
7 Gear stage
8 Gear stage
9 Gear stage
12 Housing
13 Hollow shaft
14 Sun wheel
15 Sun wheel shaft
16 Planet wheels
17 Planet wheel axles
18 Ring wheel
19 Sun wheel
20 Gear input shaft
21 Planet wheels
22 Planet wheel axles
23 Ring wheel
24 Wrap-around gear
25 Belt pulley
26 Motor shaft
27 Belt
28 Belt pulley
29 Belt drive
30 Belt pulley
31 Belt
32 Belt pulley
33 Planet wheel carrier
39 Intermediate shaft
40 Planet wheel carrier
41 Intermediate shaft
45 Overload protection
46 Pulley
47 Overload lever arm
49 Cylinder housing
50 Piston rod
51 Load cell
52 Computing unit
53 Receptacle
54 Bolt
55 Pivot pin
56 Damping feet
57 Damping plate
58 Channel
59 Shoulder
60 Machine stand
61 Rocking joint
62 Oscillation determination unit
D Axis of rotation
R Direction of rotation
A Linear movement
B Tilting movement

The invention claimed is:

1. A solid bowl screw centrifuge for processing drill sludge, comprising:

a rotatable drum;

a rotatable screw;

a drive operatively configured to drive the drum and the screw, wherein the drive includes a drive motor and a gear arrangement for generating a differential rotational speed between the drum and the screw during operation of the centrifuge;

an overload lever arm triggerable in an event of a torque overload, wherein a gear input shaft of the gear arrangement is rotationally fixable by the overload lever arm, wherein the overload lever arm is directly and detachably connected at one end thereof and at a radial distance from a rotation axis of the gear input shaft to a part connected to the gear input shaft, in a rotationally fixed manner, wherein the overload lever arm has a receptacle at the one end thereof, wherein the part connected to the gear input shaft is a pulley, and wherein the receptacle presses against a bolt of the pulley.

2. The centrifuge as claimed in claim 1, wherein the overload lever arm is supported at its other end on a machine stand.

3. The centrifuge as claimed in claim 2, wherein the overload lever arm is designed as a piston/cylinder unit.

4. The centrifuge as claimed in claim 1, wherein the overload lever arm is configured as a compression spring unit of variable length.

5. The centrifuge as claimed in claim 1, wherein the overload lever arm is designed as a piston/cylinder unit.

6. The centrifuge as claimed in claim 5, wherein the piston/cylinder unit is designed as a fluidically or mechanically acting spring element.

7. The centrifuge as claimed in claim 1, wherein the overload lever arm is designed as a torque support which in an overload event can be released from the bolt.

8. The centrifuge as claimed in claim 1, wherein the overload lever arm is of telescopic form.

9. The centrifuge as claimed in claim 1, wherein the centrifuge comprises dampers configured to damp oscillations of the centrifuge on a machine stand and/or a foundation.

10. The centrifuge as claimed in claim 1, wherein the overload lever arm is fastened at an end remote from the gear input shaft to a machine stand.

11. The centrifuge as claimed in claim 1, wherein the centrifuge comprises a torque determiner for determining a torque acting upon a piston rod of the overload lever arm.

12. The centrifuge as claimed in claim 11, wherein the torque determiner is designed as a load cell.

13. A method for monitoring torque on a gear input shaft of a solid bowl screw centrifuge according to claim 1 in clarification of drill sludge, the method comprising the acts of:

(a) clarifying the drill sludge if the torque on the gear input shaft is below a first limit value;

(b) changing at least one operating parameter of the solid bowl screw centrifuge if the torque reaches or overshoots the first limit value;

(c) shutting down the solid bowl screw centrifuge if the torque reaches or overshoots a second limit value; and (d) triggering a torque overload protection automatically or in a controlled manner if a derivation of the torque over time overshoots a limit value dM/dt.

14. The method according to claim 13, wherein, when the first limit value is reached and overshot, the changing of the at least one operating parameter occurs by shutting down inflow to the solid bowl screw centrifuge.

15. The method according to claim 14, wherein the shutting down of the solid bowl screw centrifuge occurs via shutdown of a drive of the centrifuge.

16. The method according to claim 13, wherein the shutting down of the solid bowl screw centrifuge occurs via shutdown of a drive of the centrifuge.

* * * * *